US010274254B2

(12) United States Patent
Sasaki et al.

(10) Patent No.: US 10,274,254 B2
(45) Date of Patent: Apr. 30, 2019

(54) CARBON HEAT SOURCE DRYING METHOD

(71) Applicant: JAPAN TOBACCO INC., Tokyo (JP)

(72) Inventors: Hiroshi Sasaki, Tokyo (JP); Masaaki Kobayashi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 533 days.

(21) Appl. No.: 15/047,074

(22) Filed: Feb. 18, 2016

(65) Prior Publication Data

US 2016/0161184 A1 Jun. 9, 2016

Related U.S. Application Data

(63) Continuation of application No. PCT/JP2014/074895, filed on Sep. 19, 2014.

(30) Foreign Application Priority Data

Sep. 25, 2013 (JP) ..... 2013-198369

(51) Int. Cl.
*F26B 21/10* (2006.01)
*F26B 21/08* (2006.01)
(Continued)

(52) U.S. Cl.
CPC ..... *F26B 21/10* (2013.01); *A24B 15/165* (2013.01); *F26B 21/08* (2013.01); *F26B 25/22* (2013.01); *A24F 47/006* (2013.01)

(58) Field of Classification Search
CPC ..... F26B 21/10; F26B 21/08; F26B 25/22; A24B 15/165; A24F 47/006
(Continued)

(56) References Cited

U.S. PATENT DOCUMENTS 3,571,943 A 3/1971 Sipple
4,109,664 A * 8/1978 Hedge ..... A24B 15/16 131/359
(Continued)

FOREIGN PATENT DOCUMENTS

CN 1380528 A 11/2002
CN 103112069 A 5/2013
(Continued)

OTHER PUBLICATIONS

Chinese Office Action for Application No. 201480051962.8, dated Jan. 22, 2018.
(Continued)

*Primary Examiner* — Stephen M Gravini
(74) *Attorney, Agent, or Firm* — Birch, Stewart, Kolasch & Birch, LLP

(57) ABSTRACT

When a kneaded mixture produced by adding a hinder-containing additive and water to carbon powder and kneading the mixture is formed into a rod-shaped carbon heat source (HS) and the carbon heat source (HS) is subsequently dried to manufacture a finished product, a drying method according to the present invention includes generating a dry atmosphere in which an evaporation rate (Vo) at which the water evaporates through an outer surface of the carbon heat source (HS) is made approximately equal to a speed (Vs) at which the water in the carbon heat source (HS) moves toward the outer surface while a weight absolute humidity (AH) is lowered in a stepwise manner, and drying the carbon heat source (HS) in the dry atmosphere.

7 Claims, 4 Drawing Sheets

(51) Int. Cl.
*A24B 15/16* (2006.01)
*F26B 25/22* (2006.01)
*A24F 47/00* (2006.01)

(58) Field of Classification Search
USPC ..... 34/475
See application file for complete search history.

(56) References Cited

U.S. PATENT DOCUMENTS 4,186,756 A * 2/1980 Takemoto ..... A24B 15/14 131/355
5,076,292 A * 12/1991 Sensabaugh, Jr. ... A24B 15/165 131/194
5,560,376 A 10/1996 Meiring et al.
5,699,625 A * 12/1997 Iguchi ..... F26B 13/10 34/106
7,644,716 B2 * 1/2010 Hosoya ..... A24B 15/165 131/351
7,966,741 B2 * 6/2011 Gorbell ..... C05F 3/00 34/60
8,220,180 B2 * 7/2012 Inoue ..... B29C 55/165 34/638
8,353,298 B2 * 1/2013 Braunshteyn ..... A24D 3/045 131/202
8,434,499 B2 * 5/2013 Karles ..... A24D 3/041 131/336
8,592,516 B2 * 11/2013 Weismantel ..... C08F 6/008 34/384
8,905,037 B2 * 12/2014 Lipowicz ..... A24D 1/00 131/331
9,238,215 B2 * 1/2016 Weismantel ..... C08F 6/008
2001/0015020 A1 8/2001 Uehara
2006/0201057 A1 9/2006 Hosoya et al.
2006/0278336 A1 12/2006 Sundholm et al.
2007/0101608 A1 5/2007 Sundholm
2009/0018326 A1 * 1/2009 Hashimoto ..... B29C 41/26 536/56
2016/0161184 A1 * 6/2016 Sasaki ..... F26B 21/08 34/475

FOREIGN PATENT DOCUMENTS

EP 1683431 A1 * 7/2006 ..... A24B 15/165
EP 2298819 B1 * 2/2016 ..... C08F 6/008
JP 8-332067 A 12/1996
JP 2002-86407 A 3/2002
JP 4164093 B2 * 10/2008 ..... A24B 15/165
JP 4164093 B2 10/2008
KR 100792058 B1 * 1/2008 ..... A24B 15/165
WO WO 2005/046364 A1 5/2005

OTHER PUBLICATIONS

Extended European Search Report issued in PCT/JP2014/074895, dated Apr. 11, 2017.
Japanese Office Action, dated Jul. 6, 2016, for Japanese Application No. 2015-539169.
International Search Report issued in PCT/JP2014/074895, dated Dec. 22, 2014.
Written Opinion of the International Searching Authority issued in PCT/JP2014/074895 (PCT/ISA/237), dated Dec. 22, 2014.
Communication pursuant to Article 94(3) EPC issued in corresponding EP Application No. 14848435.5 dated Feb. 18, 2019.

* cited by examiner

CARBON HEAT SOURCE DRYING METHOD

CROSS REFERENCE TO RELATED APPLICATIONS

This application is a Continuation of PCT International Application No. PCT/JP2014/074895, filed on Sep. 19, 2014, which claims priority under 35 U.S.C. 119(a) to Patent Application No. 2013-198369, filed in Japan on Sep. 25, 2013, all of which are hereby expressly incorporated by reference into the present application.

TECHNICAL FIELD

The present invention relates to a method for drying a carbon heat source used as a heat source, for example, for a smoking article.

BACKGROUND ART

A carbon heat source of this type is manufactured in the following procedure:

First, carbon powder, a burning adjustment agent, and a binder (water) are kneaded to produce a kneaded mixture, and the kneaded mixture is caused to undergo a continuous extrusion molding process to form a cylindrical, carbon heat source rod (see paragraph 0003 of Patent Document 1). The carbon heat source rod immediately after the molding process contains at least 20 wt % of water that ensures sufficient formability of the carbon heat source rod, that is, sufficient fluidity of the kneaded mixture.

Thereafter, in the process of transporting the carbon heat source rod, the carbon heat source rod is dried with a blast of hot air (see paragraphs 0019 to 0020 and FIG. 1 of Patent Document 1), and the dried carbon heat source rod is cut into a carbon heat source having a predetermined length. A final target water content in the carbon heat source is 10 wt % or lower, and water content at this level sufficiently ensures ignitability of the carbon heat source.

On the other hand, the carbon heat source rod can be dried by using a far-infrared heater (see Patent Document 2) instead of blasting hot air described in Patent Document 1.

PRIOR ART DOCUMENT

Patent Document

Patent Document 1: International Publication WO 2005/046364

Patent Document 2: International Publication WO 2009/131009

SUMMARY OF THE INVENTION

Problems to be Solved by the Invention

According to the hot-air-based drying method in Patent Document 1, the higher the temperature of the hot air, the shorter the period required to dry the carbon heat source rod. In this case, however, the outer surface of the carbon heat source rod is dried faster than the interior thereof. Since the outer surface of the carbon heat source rod exposed to the hot air is therefore first dried and starts shrinking, the carbon heat source cannot be uniformly dried, and the carbon heat source rod, that is, the carbon heat source cannot maintain the perfectness of its circular shape. Further, the non-uniformly dried carbon heat source tends to crack, which significantly degrades the quality of exterior appearance of the carbon heat source and lowers the yield thereof.

Conversely, lowering the temperature of the hot air allows a decrease in the degree of the degradation of the quality of exterior appearance described above. In this case, however, it takes a very long period to dry the carbon heat source, which lowers productivity of the carbon heat source.

On the other hand, the far-infrared-based drying method described in Patent Document 2 readily allows fine control of the heating temperature to which the carbon heat source is heated as compared with the hot-air drying but still cannot solve the problems described above.

The present invention has been made in view of the circumstances described above, and an object of the present invention is to provide a carbon heat source drying method that allows the period required for the drying to be shortened without degradation in the quality of exterior appearance of the dried carbon heat source.

Means for Solving the Problems

The above object is achieved by a carbon heat source drying method according to the present invention, and the carbon heat source drying method according to the present invention in which a kneaded mixture produced by adding a binder-containing additive and water to carbon powder and kneading the mixture is formed into a rod-shaped carbon heat source and the carbon heat source is subsequently dried to manufacture a finished product, the method including generating a dry atmosphere in which an evaporation rate at which the water evaporates through an outer surface of the carbon heat source is made approximately equal to a speed at which the water in the carbon heat source moves from a center thereof toward the outer surface while a weight absolute humidity is lowered in a stepwise manner, and drying the carbon heat source in the dry atmosphere.

According to the drying method described above, the weight absolute humidity of the dry atmosphere is lowered in a stepwise manner, but the evaporation rate at which the water evaporates through the outer surface of the carbon heat source is made approximately equal to the speed at which the water moves in the carbon heat source. The dried state of the carbon heat source therefore uniformly and quickly progresses throughout the transverse cross sections of the carbon heat source. Therefore, the carbon heat source uniformly shrinks over the entire transverse cross sections of the carbon heat source, and the shape of the transverse cross sections is not deformed. As a result, the carbon heat source is dried toward target water content with the quality of exterior appearance maintained.

Advantageous Effects of the Invention

The carbon heat source drying method according to the present invention allows a carbon heat source to be dried in a short period with deformation of the transverse cross-sectional shape of the dried carbon heat source suppressed and hence the quality of exterior appearance of the carbon heat source maintained.

MODE FOR CARRYING OUT THE INVENTION

Figure 1:
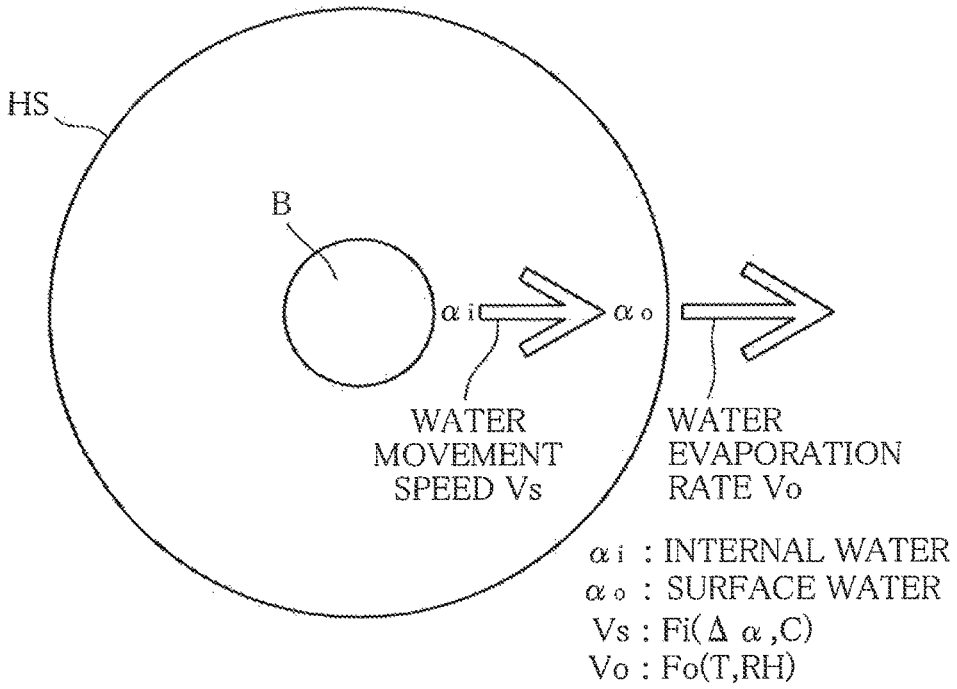
FIG. 1 schematically describes a drying method according to the present invention.

Referring to FIG. 1, an embodiment of a carbon heat source HS is shown. The carbon heat source HS has a cylindrical shape and is used as a heat source for a non-burning-type smoking article as described above. The carbon heat source HS shown in FIG. 1 has a circular center bore B at the center of the carbon heat source HS, and the center bore B extends through the carbon heat source HS.

The carbon heat source HS is manufactured, for example, by using an extruder. The extruder first kneads carbon powder, an additive containing a binder, and water to produce a kneaded mixture and causes the kneaded mixture to undergo a continuous extrusion molding process to form a cylindrical carbon heat source rod. The molded carbon heat source rod having exited out of the extruder is cut into a carbon heat source HS having a predetermined length, and the carbon heat source HS then undergoes a drying process to form a finished product. The carbon heat source HS may instead be manufactured in injection molding, punching, or any other process.

The process of drying the carbon heat source HS is carried out in a dry atmosphere, and the dry atmosphere is used throughout the period for which the carbon heat source HS is dried and provides the carbon heat source HS with the following drying profile:

Drying Profile

Vo represents the rate at which water evaporates through the outer surface of the carbon heat source HS. On the other hand, Vs represents the speed at which water moves in the carbon heat source HS toward the outer surface of the carbon heat source HS. It is assumed under the definitions described above that the dried state of the carbon heat source HS uniformly progresses throughout the transverse cross sections of the carbon heat source HS when the following relationship is satisfied:

$$Vo \approx Vs \quad (1)$$

The evaporation rate Vo is determined on the basis of the following function Fo having parameters in the form of the dry bulb temperature T of the dry atmosphere and the relative humidity RH of the dry atmosphere:

$$Vo \approx Fo(T,RH)$$

On the other hand, the movement speed Vs, at which water moves in the carbon heat source HS, is determined on the basis of the following function Fi having parameters in the form of a water difference $\Delta\alpha$, which is the difference in water content between the outer surface and the interior of the carbon heat source HS, the composition C of the carbon heat source HS, and the article temperature To of the carbon heat source HS:

$$Vs = Fi(\Delta\alpha, C, To)$$

In addition, the movement speed Vs increases as the article temperature To increases.

The water difference $\Delta\alpha$ is determined by the following expression:

$$\Delta\alpha = \alpha i - \alpha o$$

where $\alpha i$ represents the water content inside the carbon heat source HS, and $\alpha o$ represents the water content at the outer surface of the carbon heat source HS.

To satisfy the relationship of Expression (1) described above, the dry bulb temperature T of the dry atmosphere is so set that the dry atmosphere has absolute weight humidity higher than or equal to 40% of the water content in the carbon heat source HS. In an initial stage in the drying profile, the carbon heat source HS has a relatively large water content. In this case, the dry bulb temperature is set at a relatively large value.

The dry bulb temperature T is then lowered stepwise to a target temperature at the time when the carbon heat source HS has been dried, for example, room temperature (20° C.). In this regard, when the target temperature of the carbon heat source HS at the time when the dried state is achieved is sufficiently higher than room temperature, an additional period for which the carbon heat source HS is cooled is required after the drying process. When the carbon heat source HS is rapidly cooled during the cooling period, water bursts out of the surface of the carbon heat source HS and causes the balance between the evaporation rate Vo and the movement speed Vs to be lost, possibly resulting in undesired cracking in the carbon heat source HS.

According to the drying profile described above, during the process of drying the carbon heat source HS, since the water evaporation rate Vo and the water movement speed Vs are approximately equal to each other, the dried state of the carbon heat source HS uniformly progresses throughout the transverse cross sections of the carbon heat source HS without non-uniform shrinkage of the carbon heat source HS. Therefore, the perfectness of the circular shape of the carbon heat source HS is ensured, that is, the shape of the carbon heat source HS is reliably maintained, and no cracking occurs in the carbon heat source HS, unlike the situation described above. As a result, the quality of the external appearance of the carbon heat source HS can be maintained even in the drying process described above.

Further, the uniform progress of the dried state of the carbon heat source HS allows the water content in the carbon heat source HS to reach a target water content faster than in the low-temperature drying described above, not only contributing to a shorter drying period but also allowing a carbon heat source HS that excels in the quality of exterior appearance as compared with the high-temperature drying type to be manufactured.

Figure 2:
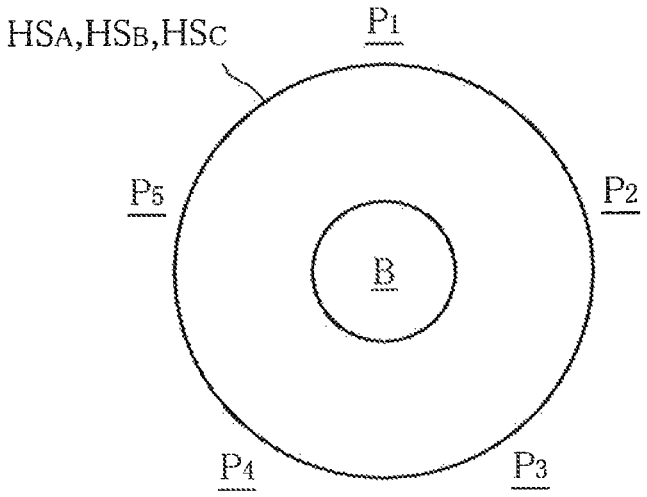
FIG. 2 shows an end surface of a pipe-shaped carbon heat source.
Figure 3:
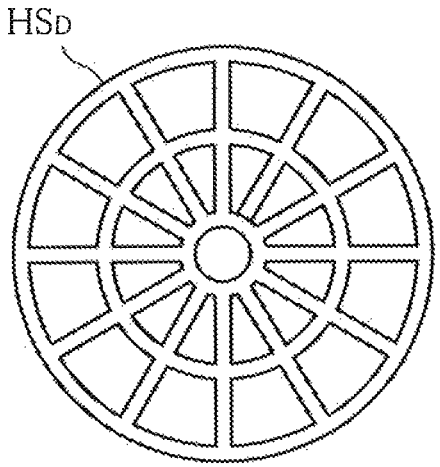
FIG. 3 shows an end surface of a carbon heat source having a honeycomb structure.

To verify the effect of the drying profile described above, three types of carbon heat source $HS_A$, $HS_B$, and $HS_C$, which belong to Example 1, and one type of carbon heat source $HS_D$, which belongs to Example 2, were formed in extrusion molding. As shown in FIG. 2, each of the carbon heat sources $HS_A$, $HS_B$, and $HS_C$ has the same pipe shape as that of the carbon heat source HS shown in FIG. 1, whereas the carbon heat source $HS_D$ has a honeycomb structure.

In the present embodiment, each of the carbon heat sources $HS_A$, $HS_B$, $HS_C$, and $HS_D$ has an outer diameter ranging from about 6 to 8 mm, and each of the carbon heat sources $HS_A$, $HS_B$, and $HS_C$, has an inner diameter ranging from about 1 to 3 mm.

The compositions of the carbon heat sources $HS_A$, $HS_B$, and $HS_C$ before they are dried are shown in the following Table 1.

TABLE 1

Compositions of carbon heat sources HSA, HSB, and HSC

| | Article name | Blending ratio (g) HSA | HSB | HSC |
|---|---|---|---|---|
| Carbon powder | Highly activated carbon | 40 | 40 | 41 |
| Additive | Calcium carbonate | 54 | 50 | 54 |
| | Binder | 5 | 10 | 5 |
| | Purified salt | 1 | 0 | 0 |
| Water | — | 113 | 113 | 150 |
| Water content (wt %) | — | 53 | 53 | 60 |

As apparent from Table 1, each of the carbon heat sources $HS_A$, $HS_B$, and $HS_C$ in Example 1 is formed of a mixture of activated carbon having undergone activation as carbon powder, an additive, and water, and the additive contains calcium carbonate, a binder, and purified salt. The calcium carbonate acts as a burning adjustment agent, and the binder is at least one substance selected from carboxymethylcellulose sodium, ammonium alginate, pectin, and carrageenan.

On the other hand, the composition of the carbon heat source $HS_D$ before it is dried is shown in the following Table 2.

TABLE 2

Compositions of carbon heat sources HSD

| | Article name | Blending ratio (g) HSD |
|---|---|---|
| Carbon powder | Activated carbon | 35 |
| Additive | Calcium carbonate | 45 |
| | Binder | 10 |
| | Glycerin | 10 |
| Water | — | 32 |
| Water content (wt %) | — | 24 |

As apparent from Table 2, the carbon heat source $HS_D$ in Example 2 is a mixture of activated carbon, an additive, and water, as in Example 1. The additive In Example 2, however, contains calcium carbonate, a binder, and glycerin, and the binder is at least one substance selected from carboxymethylcellulose, ammonium alginate, pectin, and carrageenan.

Process of Drying Carbon Heat Source $HS_A$

The carbon heat source $HS_A$ was caused to undergo high-humidity drying under a dry atmosphere according to a drying profile shown in the following Table 3:

TABLE 3

Drying profile in accordance with which carbon heat source HSA is dried (high-humidity drying)

| | Drying stage No. 1 | 2 | 3 | 4 | 5 | 6 |
|---|---|---|---|---|---|---|
| Dry bulb temperature T (° C.) | 80 | 60 | 60 | 60 | 40 | 30 |

TABLE 3-continued

Drying profile in accordance with which carbon heat source HSA is dried (high-humidity drying)

| | Drying stage No. 1 | 2 | 3 | 4 | 5 | 6 |
|---|---|---|---|---|---|---|
| Relative humidity RH (%) | 70 | 80 | 60 | 40 | 60 | 60 |
| Weight absolute humidity AH (kg/kg) | 0.303 | 0.1163 | 0.0833 | 0.0532 | 0.0284 | 0.016 |
| Drying period (H) | 1 | 1 | 1.5 | 1.5 | 1.5 | — |

As apparent from Table 3, the drying profile in accordance with which the carbon heat source $HS_A$ is dried includes a plurality of drying stages. The dry bulb temperature T and the relative humidity RH of the dry atmosphere in each of the drying stages are so set that the weight absolute humidity AH, which is determined by the dry bulb temperature T and the relative humidity RH, is at least 40% of the water content in the carbon heat source $HS_A$ in the corresponding drying stage to which the carbon heat source $HS_A$ has transitioned. Therefore, between adjacent drying stages, since the degree of dryness of the carbon heat source $HS_A$ has increased in the earlier stage, the weight absolute humidity AH of the dry atmosphere in the later stage is lowered in a stepwise manner. Table 3 shows drying stages 1 to 6.

For example, since the carbon heat source $HS_A$ has large water content in the first drying stage 1 (see Table 1), the weight absolute humidity AH is so set as to be at least 40% of the water content in the carbon heat source $HS_A$. To this end, the dry bulb temperature T of the dry atmosphere is set at a relatively large value, which allows water in the carbon heat source $HS_A$ to effectively evaporate therefrom. The dry bulb temperature T in the drying stage 1 is set to be higher than or equal to the dry bulb temperatures in the subsequent drying stages.

Further, as apparent from Table 3, since the dry bulb temperature T is also lowered stepwise to roughly room temperature as the drying stages proceed, no process of rapidly cooling the carbon heat source $HS_A$ is required after the carbon heat source $HS_A$ has been dried. Such rapid cooling tends to cause cracking and other undesirable phenomena in the outer surface of the carbon heat source $HS_A$, but no rapid cooling is required, whereby the quality of exterior appearance of the carbon heat source $HS_A$ is not degraded due to cracking and other undesirable phenomena.

Further, the water evaporation rate Vo and the water movement speed Vs both decrease as the degree of dryness of the carbon heat source $HS_A$ progresses. However, as apparent from Table 3, since the drying period is set to be longer in the later drying stages 3 to 5 than in the earlier drying stages 1 and 2, the degree of dryness of the carbon heat source $HS_A$ is allowed to effectively progress through the later drying stages 3 to 5.

The weight absolute humidity AH can be read out, for example, from a psychrometric chart or a conversion table having parameters in the form of the dry bulb temperature T and the relative humidity RH.

Figure 4:
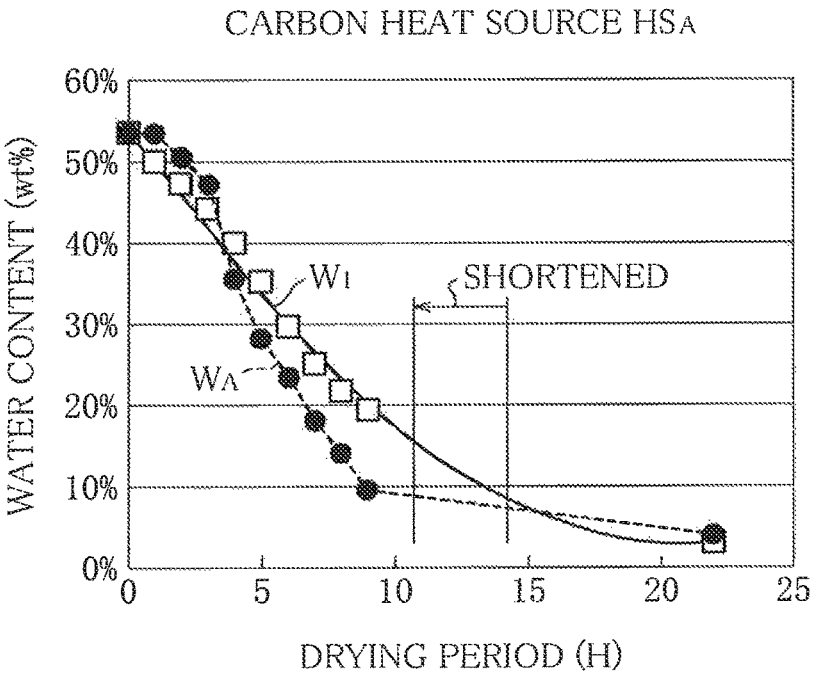
FIG. 4 shows graphs illustrating the relationship between a drying period and water content in a carbon heat source $HS_A$ during the process of drying the carbon heat source $HS_A$.

FIG. 4 shows changes in the water content $W_A$ in the carbon heat source $HS_A$ in a case where the carbon heat source $HS_A$ is caused to undergo the high-humidity drying in accordance with the drying profile shown in Table 3. FIG. 4 further shows changes in the water content $W_1$ in the carbon heat source $HS_A$ in a case where the carbon heat source $HS_A$ is caused to undergo fixed-temperature drying under conditions of fixed-temperature drying 1.

The following Table 4 shows conditions of the fixed-temperature drying 1.

TABLE 4

| Fixed-temperature drying 1 | |
|---|---|
| Drying stage No. | 1 |
| Dry bulb temperature T (° C.) | 40 |
| Drying period (H) | 23 |

As apparent from Table 4, in the fixed-temperature drying 1, the dry bulb temperature T of the dry atmosphere was set at a fixed temperature (40° C.), and the carbon heat source $HS_A$ was dried while the dry atmosphere is replaced with a new one as appropriate.

As apparent from FIG. 4, the water content. $W_A$ in the carbon heat source $HS_A$ having undergone the high-humidity drying reaches a target water content (lower than or equal to 10 wt %) faster than the water content $W_1$ in the carbon heat source $HS_A$ having undergone the fixed-temperature drying. The high-humidity drying according to the drying profile shown in Table 3 therefore allows the period required to dry the carbon heat source $HS_A$ to be greatly shortened, as compared with the fixed-temperature drying.

As apparent from comparison between the drying profile shown in Table 3 and the changes in the water content $W_1$ shown in FIG. 4, the dry atmosphere in each of the drying stages has a weight absolute humidity AH higher than or equal to 40% of the water content $W_A$ in the carbon heat source $HS_A$ in the drying stage to which the carbon heat source $HS_A$ has transitioned.

On the other hand, 50 carbon heat sources $HS_A$ having undergone the high-humidity drying were prepared, and the outer diameter of each of the carbon heat sources $HS_A$ was measured. The following Table 5 shows results of the measurement and evaluation results obtained on the basis of the measurement results.

TABLE 5

| High-humidity drying | | | | |
|---|---|---|---|---|
| Number of samples having been measurements N (N = 50) | Dmax (mm) | Dmin (mm) | Two-point average (mm) | Five-point average (mm) |
| MAX | 6.341 | 6.229 | 60276 | 6.283 |
| MIN | 6.145 | 6.100 | 6.130 | 6.132 |
| Av | 6.246 | 6.169 | 6.123 | 6.126 |
| σ | 0.037 | 0.037 | 0.030 | 0.030 |

Table 5 will be specifically described. The outer diameter of the carbon heat source $HS_A$ was measured at points P1 to P5 shown in FIG. 2 on a measured sample basis. The measurement points P1 to P5 are separate from each other in the circumferential direction of the carbon heat source $HS_A$. In the vertical column associated with the maximum outer diameter Dmax of the carbon heat source $HS_A$ in Table 5, MAX, MIN, Av, and σ represent a maximum, a minimum, an average, and a standard deviation of the maximum outer diameters Dmax of the entire measured samples.

Similarly, in the vertical column associated with the minimum outer diameter Dmin of the carbon heat source $HS_A$ and the vertical columns associated with the two-point and, five-point averages of the outer diameter in Table 5, MAX, MIN, Av, and σ represent a maximum, a minimum, an average, and a standard deviation of the minimum outer diameters Dmin, the two-point averages, and the five-point averages of the entire measured samples.

The two-point average represents the average of the maximum and the minimum of the outer diameters measured at the measurement points P1 to P5 on a measured sample basis, and the five-point average represents the average of the outer diameters measured at the entire measurement points P1 to P5.

Further, 50 carbon heat sources $HS_A$ having undergone the fixed-temperature drying were prepared, and the outer diameter of each of the carbon heat sources $HS_A$ was also measured. The following Table 6 shows results of the measurement and evaluation results obtained on the basis of the measurement results in the same form as that of Table 5

TABLE 6

| Fixed-temperature drying 1 | | | | |
|---|---|---|---|---|
| Number of samples having been measurements N (N = 50) | Dmax (mm) | Dmin (mm) | Two-point average (mm) | Five-point average (mm) |
| MAX | 6.268 | 6.224 | 6.246 | 6.240 |
| MIN | 5.915 | 5.814 | 5.868 | 5.858 |
| Av | 6.159 | 6.087 | 6.123 | 6.126 |
| σ | 0.076 | 0.079 | 0.074 | 0.074 |

As apparent from comparison, between the evaluation results shown in Tables 5 and 6, particularly in terms of the standard deviations σ associated with the maximum outer diameter Dmax and the minimum outer diameter Dmin, the perfectness of the circular shape of the carbon heat source $HS_A$ having undergone the high-humidity drying in accordance with the drying profile shown in Table 3 is more preferably maintained than the perfectness of the circular shape of the carbon heat source $HS_A$ having undergone the fixed-temperature drying.

Further, comparison of the standard deviations σ associated with the two-point average and the five-point average also shows that the standard deviation a in the high-humidity drying is smaller than the standard deviation a in the fixed-temperature drying, which means that the transverse cross-sectional shape of the carbon heat source $HS_A$ shrinks with similarity of the shape maintained both before and after the drying process.

Process of Drying Carbon Heat Sources $HS_B$ and $HS_C$

The carbon heat source $HS_B$ was caused to undergo the high-humidity drying under a dry atmosphere according to a drying profile shown in the following Table 7:

TABLE 7

| Drying profile in accordance with which carbon heat source HSB is dried (high-humidity drying) | | | | | | |
|---|---|---|---|---|---|---|
| | Drying stage No. | | | | | |
| | 1 | 2 | 3 | 4 | 5 | 6 |
| Dry bulb temperature T (° C.) | 80 | 60 | 60 | 60 | 40 | 40 |
| Relative humidity RH (%) | 70 | 80 | 60 | 40 | 60 | 40 |

TABLE 7-continued

| Drying profile in accordance with which carbon heat source HSB is dried (high-humidity drying) | | | | | | |
|---|---|---|---|---|---|---|
| | Drying stage No. | | | | | |
| | 1 | 2 | 3 | 4 | 5 | 6 |
| Weight absolute humidity AH (kg/kg) | 0.303 | 0.1163 | 0.0833 | 0.0532 | 0.0284 | 0.0187 |
| Drying period (H) | 1 | 1 | 1 | 1 | 1 | — |

On the other hand, the carbon heat source $HS_C$ was caused to undergo the high-humidity drying under a dry atmosphere according to a drying profile shown in the following Table 8:

TABLE 8

| Drying profile in accordance with which carbon heat source HSC is dried (high-humidity drying) | | | | | | |
|---|---|---|---|---|---|---|
| | Drying stage No. | | | | | |
| | 1 | 2 | 3 | 4 | 5 | 6 |
| Dry bulb temperature T (° C.) | 80 | 60 | 60 | 60 | 40 | 40 |
| Relative humidity RH (%) | 70 | 80 | 60 | 40 | 80 | 40 |
| Weight absolute humidity AH (kg/kg) | 0.303 | 0.1163 | 0.0833 | 0.0532 | 0.0384 | 0.0187 |
| Drying period (H) | 1 | 1 | 1 | 1 | 1 | — |

As apparent from Tables 7 and 8, the drying profiles in accordance with which the carbon heat sources $HS_B$ and $HS_C$ are dried include a plurality of drying stages. The dry bulb temperature T and the relative humidity RH of the dry atmosphere in each of the drying stages are so set that the weight absolute humidity AH, which is determined by the dry bulb temperature T and the relative humidity RH, is at least 40% of the water content in the carbon heat source $HS_A$ in the corresponding drying stage to which the carbon heat source $HS_A$ has transitioned. Further, the weight absolute humidity AH is lowered in a stepwise manner between adjacent drying stages.

Therefore, the drying profiles shown in Tables 7 and 8 are basically the same as the drying profile shown in Table 3 but differ therefrom in that the drying period is fixed throughout the drying stages.

Figure 5:
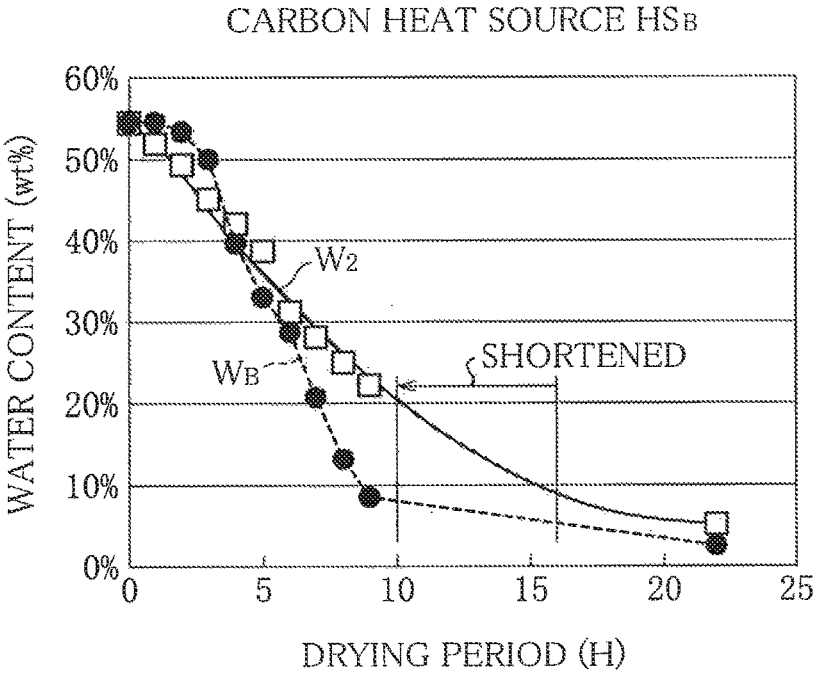
FIG. 5 shows graphs illustrating the relationship between the drying period and the water content in a carbon heat source $HS_B$ during the process of drying the carbon heat source $HS_B$.
Figure 6:
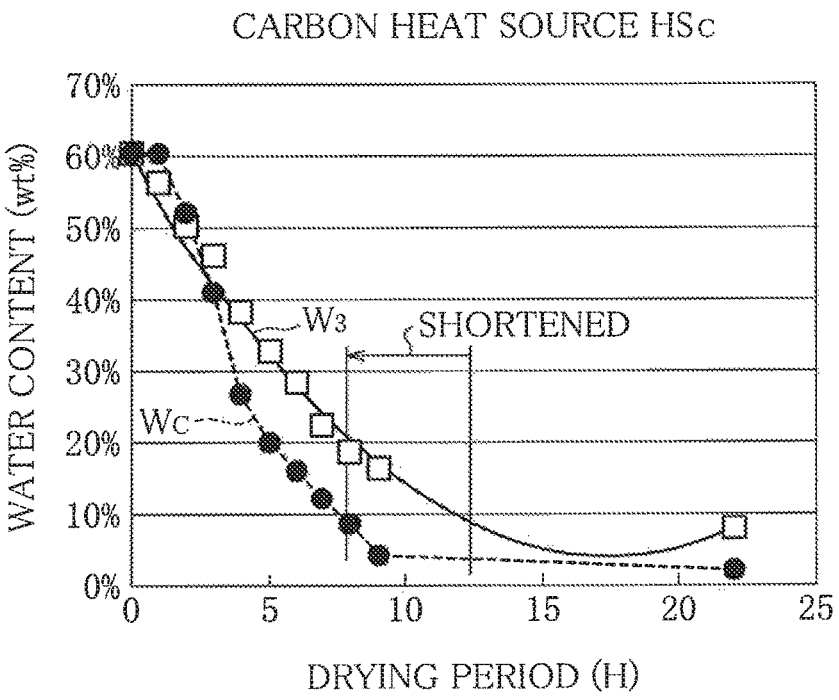
FIG. 6 shows graphs illustrating the relationship between the drying period and the water content in a carbon heat source $HS_C$ during the process of drying the carbon heat source $HS_C$.

FIG. 5 shows changes in the water content $W_B$ in the carbon heat source $HS_B$ in a case where the carbon heat source $HS_B$ is caused to undergo the high-humidity drying and further shows changes in the water content $W_2$ in the carbon heat source $HS_B$ in a case where the carbon heat source $HS_B$ is caused to undergo the fixed-temperature drying. FIG. 6 shows changes in the water content $W_C$ in the carbon heat source $HS_B$ in a case where the carbon heat source $HS_C$ is caused to undergo the high-humidity drying and further shows changes in the water content $W_3$ in the carbon heat source $HS_C$ in a case where the carbon heat source $HS_C$ is caused to undergo the fixed-temperature drying. The processes of drying the carbon heat sources $HS_B$ and $HS_C$ at fixed-temperatures were carried out under the same conditions as those in the process of drying the carbon heat sources $HS_A$ at a fixed-temperature described above.

As apparent from FIGS. 5 and 6, it is indicated that the water contents $W_B$ and $W_C$ in the carbon heat sources $HS_B$ and $HS_C$ having undergone the high-humidity drying reach a target water content (smaller than or equal to 10 wt %) faster than the water contents $W_2$ and $W_3$ in the carbon heat sources $HS_B$ and $HS_C$ having undergone the fixed-temperature drying. It is further ascertained that the perfectness of the circular shapes of the carbon heat sources $HS_B$ and $HS_C$ having undergone the high-humidity drying is maintained by a greater degree than the perfectness of the circular shapes of the carbon heat sources $HS_B$ and $HS_C$ having undergone the fixed-temperature drying.

Also in the drying profile shown in Table 7 (or Table 8), the weight absolute humidity AH of the dry atmosphere in each of the drying stages is, of course, at least 40% of the water content $W_B$ (or $W_C$) in the carbon heat source $HS_B$ (or $HS_C$) in the drying stage to which the carbon heat source $HS_B$ (or $HS_C$) has transitioned.

Process of Drying Carbon Heat Source $HS_D$

The carbon heat source $HS_D$ was caused to undergo the high humidity drying under a dry atmosphere according to a drying profile shown in the following Table 9:

TABLE 9

| Drying profile in accordance with which carbon heat source HSD is dried (high-humidity drying) | | | | |
|---|---|---|---|---|
| | Drying stage No. | | | |
| | 1 | 2 | 3 | 4 |
| Dry bulb temperature T (° C.) | 60 | 60 | 25 | 25 |
| Relative humidity RH (%) | 80 | 60 | 60 | 60 |
| Weight absolute humidity AH (kg/kg) | 0.1163 | 0.0833 | 0.0119 | 0.0119 |
| Drying period (H) | 1 | 1 | 1 | 1 |

As apparent from Table 9, the drying profile in accordance with which the carbon heat source $HS_D$ is dried includes a plurality of drying stages. The weight absolute humidity AH in the dry atmosphere is lowered stepwise between adjacent drying stages, and the weight absolute humidity AH is also at least 40% of the water content in the carbon heat source $HS_D$ to which the carbon heat source $HS_D$ has transitioned.

In the drying profile in accordance with which the carbon heat source $HS_D$ is dried, the dry bulb temperature T of the dry atmosphere in the drying stage 1 is lower than those in the drying profiles described above. The reason for this is that initial water content in the carbon heat source $HS_D$ is 24%, which is lower than those in the carbon heat source $HS_A$, $HS_B$, and $HS_C$ described above (see Tables 1 and 2).

Further, in the drying profile in accordance with which the carbon heat source $HS_D$ is dried, the weight absolute humidity AH of the dry atmosphere in each of the drying stages is preferably higher than or equal to 40% but close to 40%.

Figure 7:
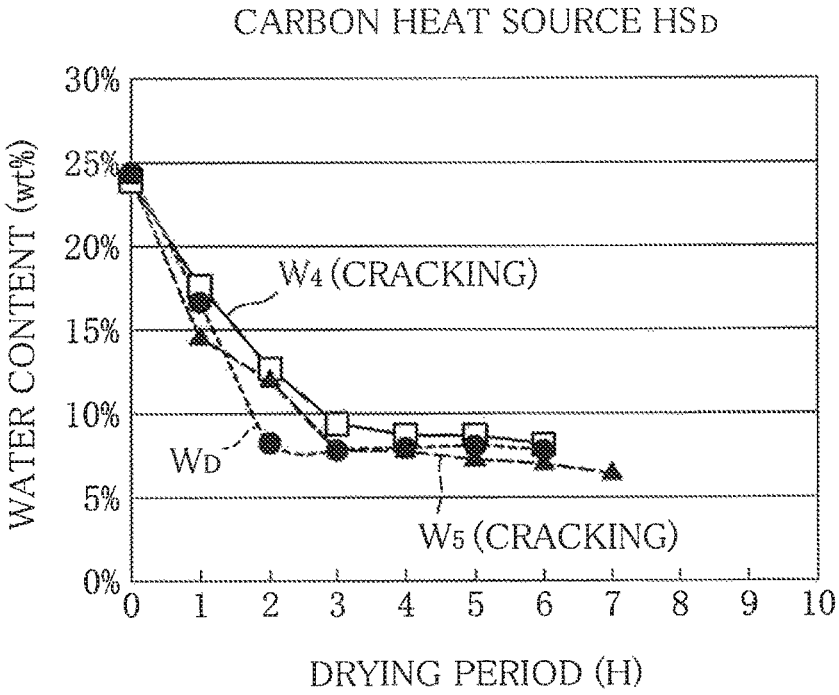
FIG. 7 shows graphs illustrating the relationship between the drying period and the water content in a carbon heat source $HS_D$ during the process of drying the carbon heat source $HS_D$.

FIG. 7 shows changes in the water content $W_D$ in the carbon heat source $HS_D$ in a case where the carbon heat source $HS_D$ is caused to undergo the high-humidity drying in accordance with a drying profile shown in Table 9. FIG. 7 further shows changes in the water contents $W_4$ and $W_5$ in the carbon heat source $HS_D$ in a case where the carbon heat source $HS_D$ is dried.

The following Table 10 shows conditions of fixed-temperature drying 2.

TABLE 10

| Fixed-temperature drying 2 | |
|---|---|
| Drying stage No. | 1 |
| Dry bulb temperature T (° C.) | 25 |
| Relative humidity RH (%) | 55 |
| Weight absolute humidity AH (kg/kg) | 0.0099 |
| Drying period (H) | 6 |

The following Table 11 shows conditions of fixed-temperature drying 3.

TABLE 11

| Fixed-temperature drying 3 | |
|---|---|
| Drying stage No. | 1 |
| Dry bulb temperature T (° C.) | 15 |
| Relative humidity RH (%) | 35 |
| Weight absolute humidity AH (kg/kg) | 0.0037 |
| Drying period (H) | 7 |

In the fixed-temperature drying 2 and 3, the dry bulb temperature T of the dry atmosphere is lower than that in the fixed-temperature drying 1 described above, and the relative humidity RH is so maintained that the weight absolute humidity AH is fixed, unlike in the fixed-temperature drying 1.

As apparent from FIG. 7, the water content $W_D$ in the carbon heat source $HS_D$ having undergone the high-humidity drying reaches a target water content (smaller than or equal to 10 wt %) faster than the water contents $W_4$ and $W_5$ in the carbon heat source $HS_D$ having been dried under the conditions of the fixed-temperature drying 2 and 3. The high-humidity drying thus contributes to shortening of the drying period. It is further ascertained that the perfectness of the circular shape of the carbon heat source $HS_D$ having undergone the high-humidity drying is superior to the perfectness of the circular shape of the carbon heat source $HS_D$ having undergone the fixed-temperature drying.

It is further ascertained that no cracking has occurred in the carbon heat source $HS_D$ having undergone the high-humidity drying but cracking has occurred in the carbon heat source $HS_D$ having undergone in either type of fixed-temperature drying. The reason for this is conceivably that the carbon heat source $HS_D$ has a honeycomb structure, which is weaker than the pipe structure. In this regard, no cracking has occurred in the pipe-shaped carbon heat sources $HS_A$, $HS_B$, and $HS_C$ irrespective of the drying type, the high-humidity drying or the fixed-temperature drying.

The present invention is not limited to the embodiment described above, for example, not limited to the constituents of the carbon heat source HS other than the carbon particles and those illustrated in the tables and figures, and can be changed in accordance with the form in which the carbon heat source HS is used.

EXPLANATION OF REFERENCE SIGNS

HS Carbon heat source
B Center bore
Dry bulb temperature
RH Relative humidity
AH Weight absolute humidity
Vo water evaporation rate
Vs Water movement speed

The invention claimed is:

1. A carbon heat source drying method in which a kneaded mixture produced by adding a binder-containing additive and an amount of water to carbon powder and kneading the mixture is formed into a rod-shaped carbon heat source and the carbon heat source is subsequently dried to manufacture a finished product, characterized in that the method comprises:

generating a dry atmosphere in the carbon heat source in which an evaporation rate at which the water evaporates through an outer surface of the carbon heat source is made approximately equal to a speed at which the water in the carbon heat source moves from a center thereof toward the outer surface of the carbon heat source while a weight absolute humidity of the carbon heat source is lowered in a stepwise manner; and drying the carbon heat source in the dry atmosphere.

2. The carbon heat source drying method according to claim 1, characterized in that the drying of the carbon heat source is carried out in a plurality of drying stages in accordance with a degree of dryness of the carbon heat source that represents the amount of water in the carbon heat source where the degree of dryness increases as the amount of water in the carbon heat source decreases, and each of the drying stages has either a different dry bulb temperature or a different relative humidity of the dry atmosphere.

3. The carbon heat source drying method according to claim 2, characterized in that the dry bulb temperature and the relative humidity of the dry atmosphere in each of the drying stages are so determined as to maintain a transverse cross-sectional shape of the carbon heat source irrespective of the degree of dryness of the carbon heat source.

4. The carbon heat source drying method according to claim 2, characterized in that the dry bulb temperature in a first drying stage of the plurality of drying stages is set at a value greater than or equal to the dry bulb temperatures of the rest of the drying stages.

5. The carbon heat source drying method according to claim 4, characterized in that the weight absolute humidity of the carbon heat source in each of the drying stages corresponds to at least 40% of the amount of water in the carbon heat source in an adjacent drying stage to which the carbon heat source has transitioned.

6. The carbon heat source drying method according to claim 3, characterized in that the dry bulb temperature in the first drying stage of the plurality of drying stages is set at a value greater than or equal to the dry bulb temperatures of the rest of the drying stages.

7. The carbon heat source drying method according to claim 6, characterized in that the weight absolute humidity of the carbon heat source in each of the drying stages corresponds to at least 40% of the amount of water in the carbon heat source in the adjacent drying stage to which the carbon heat source has transitioned.

* * * * *